US010125410B2

(12) United States Patent
Belov et al.

(10) Patent No.: US 10,125,410 B2
(45) Date of Patent: Nov. 13, 2018

(54) HEAT RESISTANT ALUMINUM BASE ALLOY AND WROUGHT SEMIFINSIHED PRODUCT FABRICATION METHOD

(71) Applicant: NATIONAL UNIVERSITY OF SCIENCE AND TECHNOLOGY "MISIS", Moscow (RU)

(72) Inventors: Nikolay Alexandrovich Belov, Moscow (RU); Alexander Nikolaevich Alabin, Moscow (RU)

( * ) Notice: Subject to any disclaimer, the term of this patent is extended or adjusted under 35 U.S.C. 154(b) by 320 days.

(21) Appl. No.: 14/650,001

(22) PCT Filed: Dec. 6, 2012

(86) PCT No.: PCT/RU2012/001027
§ 371 (c)(1),
(2) Date: Jun. 5, 2015

(87) PCT Pub. No.: WO2014/088449
PCT Pub. Date: Jun. 12, 2014

(65) Prior Publication Data

US 2015/0315689 A1 Nov. 5, 2015

(51) Int. Cl.

| | |
|---|---|
| ***C22F 1/04*** | (2006.01) |
| ***C22C 1/02*** | (2006.01) |
| ***C22C 21/12*** | (2006.01) |
| ***C22F 1/057*** | (2006.01) |
| ***C22C 21/00*** | (2006.01) |
| ***C22C 21/14*** | (2006.01) |
| ***C22F 1/02*** | (2006.01) |

(52) U.S. Cl.
CPC ..... *C22C 1/02* (2013.01); *C22C 1/026* (2013.01); *C22C 21/00* (2013.01); *C22C 21/12* (2013.01); *C22C 21/14* (2013.01); *C22F 1/02* (2013.01); *C22F 1/04* (2013.01); *C22F 1/057* (2013.01)

(58) Field of Classification Search
CPC ..... C22F 1/057; C22F 1/04
USPC ..... 148/552
See application file for complete search history.

(56) References Cited

U.S. PATENT DOCUMENTS

| | | | | |
|---|---|---|---|---|
| 2003/0102060 | A1 | 6/2003 | Daaland et al. | |
| 2005/0034793 | A1* | 2/2005 | Henry et al. | 148/551 |
| 2008/0308196 | A1 | 12/2008 | Chung | |

FOREIGN PATENT DOCUMENTS

| | | | |
|---|---|---|---|
| CN | 101724770 | A | 6/2010 |
| EA | 003950 | B1 | 10/2003 |
| JP | 2011042823 | A | 3/2011 |
| RU | 2446222 | C1 | 3/2012 |

OTHER PUBLICATIONS

International Search Report of PCT/RU2012/001027, dated Sep. 5, 2013.

* cited by examiner

*Primary Examiner* — Edward M Johnson
(74) *Attorney, Agent, or Firm* — Lambert & Associates; Gary E. Lambert; David J. Connaughton, Jr.

(57) ABSTRACT

This invention relates to metallurgy, more specifically, to wrought aluminum base alloys, and can be used for the fabrication of products with up to 350° C. working temperature range. The technical result achieved in the first and second objects of this invention is providing a new heat resistant aluminum base alloy the wrought semifinished products of which (sheets, rods, wire, die forgings products or pipes) have high strength, heat resistance and electrical conductivity.

Said technical result is achieved in the first object of this invention as follows.

The aluminum base alloy contains copper, manganese, zirconium, silicon, iron and chromium in the following amounts, wt. %:

| | |
|---|---|
| Copper | 0.6-1.5 |
| Manganese | 1.2-1.8 |
| Zirconium | 0.2-0.6 |
| Silicon | 0.05-0.25 |
| Iron | 0.1-0.4 |
| Chromium | 0.01-0.3 |
| Aluminum | balance |

The alloy contains zirconium in its structure in the form of $Al_3Zr$ phase nanosized particles not greater than 20 nm in size, and manganese mainly forms secondary particles of the $Al_{20}Cu_2Mn_3$ phase not greater than 500 nm in size in a quantity of at least 2 vol. %.

Said technical result is achieved in the second object of this invention as follows.

The method of fabricating wrought semifinished products from said aluminum base alloy comprises producing a melt of the alloy and fabricating a cast piece by solidifying said alloy, these operations being carried out at a temperature that is at least 50° C. above the liquidus temperature.

The intermediate wrought semifinished product is obtained by deforming said cast piece at a temperature of within 350° C. in two stages with an intermediate 340-450° C. anneal. Then the intermediate wrought semifinished product is annealed at 340-450° C., and wrought semifinished product is obtained by deforming the intermediate wrought semifinished product at room temperature. Finally the wrought semifinished product is annealed at 300-400° C.

4 Claims, 2 Drawing Sheets a)

b)

HEAT RESISTANT ALUMINUM BASE ALLOY AND WROUGHT SEMIFINSIHED PRODUCT FABRICATION METHOD

CROSS REFERENCE TO RELATED APPLICATIONS

This application is the National Stage of and claims priority on PCT/RU2012/001027 filed on Dec. 6, 2012, the disclosures of which is incorporated by reference.

FIELD OF THE INVENTION

This invention relates to metallurgy, more specifically, to wrought aluminum base alloys, and can be used for the fabrication of products with up to 350° C. working temperature range.

The high temperature strength of the alloy provided herein greatly broadens the range of products due to lower weight and longer service life.

The alloy can be used for the fabrication of various engine parts such as cases, lids, nozzles, valves, flanges etc. It is recommended as an alternative for steels and cast iron for the fabrication of water intake fittings and submersible pump stages for the oil and gas industry. This alloy can also be used for the fabrication of electrical equipment where a combination of a high electrical conductivity, sufficient strength and thermal stability is required, e.g. self-carrying wires of power transmission lines, contact wires of high speed railways, airplane wiring etc.

BACKGROUND ART

Wrought aluminum alloys of the Al—Cu—Mn system have relatively high room temperature strength, good manufacturability for forming operation and high heat resistance (to 250-300° C.). The optimum copper content in these alloys is 5-7% (hereinafter, in wt. %) which is equal or slightly higher compared to its maximum solubility in the aluminum solid solution (Al). This copper content leads to the formation of the maximum quantity of secondary $Al_2Cu$ phase precipitates during aging. Furthermore, all these alloys contain manganese in an amount of up to 1% which provides for their heat resistance and up to 0.25% zirconium which noticeably increases the stability of the aluminum solid solution by raising the recrystallization onset temperature.

Known is, for example, the AA2219 aluminum base alloy (Hatch J. E. (ed.) Aluminum: Properties and Physical Metallurgy, ASM, Metals. Park, 1984 И Kaufman G. J. Properties of Aluminum Alloys: Fatigue Data and Effects of Temperature, Product Form, and Process Variables, Materials Park, ASM International, 2008, 574 p.) which contains 5.8-6.3% Cu, 0.2-0.4% Mn, 0.02-0.10% Ti, 0.05-0.15% V and 0.1-0.25% Zr.

Wrought semifinished products fabricated from this alloy ingots have relatively good room temperature mechanical properties. The high heat resistance of the AA2219 alloy at temperatures of up to 250-300° C. is mainly accounted for by the presence of the $Al_{20}Cu_2Mn_3$ phase fine particles the content of which is within 1.5 vol. %.

Disadvantages of the above alloy are as follows. Heating this alloy to above 300° C. greatly reduces its strength due to the coarsening of the main reinforcing phase $Al_2Cu$. Moreover, the method of fabricating wrought semifinished products from ingots is quite complex and includes high temperature homogenizing anneal, forming operation, heating the semifinished products to above 500° C. for quenching, water quenching and aging which makes the final product expensive. As a result of the high temperature homogenizing anneal of the AA2219 alloy, the secondary $Al_{20}Cu_2Mn_3$ phase particles which determine the high temperature structural strength of the alloy become more than 500 nm in size. The low corrosion resistance of the AA2219 alloy requires the use of various protective coatings, and the low electrical conductivity of the AA2219 alloy (within 30% IACS in the T6 state) limits its electrical engineering applications. The main origin of its low electrical conductivity is the high content of alloying additions in the aluminum solid solution, e.g. copper and manganese.

Known is a high temperature high strength aluminum alloy, semiconductor wire, air wire and fabrication method (EP 0 787 811 A1, publ, Aug. 6, 1997). According to said invention, the aluminum base alloy contains 0.28-0.8% Zr; 0.1-0.8% Mn; 0.1-0.4% Cu; 0.16-0.3% Si and other additives. The method of wire fabrication from that alloy includes producing an alloy at a temperature of at least $750+227\cdot(Z-0.28)$° C. (where Z is the zirconium concentration in the alloy, wt. %), cooling at a rate of at least 0.1 K/s, fabricating the first (cast) piece, heat treatment of said cast piece at 320-390° C. for 30-200 h and deforming.

Disadvantages of said invention include the insufficient electrical conductivity of the alloy (lower than 53% IACS) and long heat treatment (more than 30 hours). The invention does not disclose the fabrication of any other wrought semifinished products than wires (e.g. sheets) from that alloy. Another disadvantage of that material is the insufficient heat resistance due to the low content of $Al_{20}Cu_2Mn_3$ phase fine particles which determine the high temperature structural strength of the alloy.

The closest counterpart of this invention is the heat resistant aluminum base alloy and wrought semifinished product fabrication method (RU 2446222, publ. Mar. 27, 2012). The alloy contains the following component percentages: 0.9-1.9% Cu; 1.0-1.8% Mn; 0.2-0.64% Zr; 0.01-0.12% Sc; 0.15-0.4% Fe and 0.05-0.15% Si. The zirconium and scandium additives provide for the good mechanical properties of that alloy compared to AA2219 not only at room temperature but also after long-term 300° C. heat treatment.

The method of fabricating wrought semifinished products according to said invention includes producing a melt at a temperature that is at least 50° C. above the liquidus temperature, producing a cast piece by solidifying the alloy, deforming said cast piece at a temperature of within 350° C., an intermediate 300-455° C. anneal of the wrought piece, room temperature deforming of the annealed piece and a 300-350° C. to obtain the wrought semifinished product.

Disadvantages of said invention include the significant degradation of its strength on heating to above 550° C. due to the drastic coarsening of $Al_3(Zr,Sc)$ phase fine particles. This hinders the application of that material for high temperature soldering at 560-600° C., and the high price of scandium makes final products too expensive and limits their applications. Another disadvantage of the alloy is the rapid decomposition of the aluminum solid solution with the precipitation of $Al_3(Zr,Sc)$ phase fine particles during cast piece deforming which reduces forming operation manufacturability.

DISCLOSURE OF THE INVENTION

The technical result achieved in the first and second objects of this invention is providing a new heat resistant aluminum base alloy the wrought semifinished products of which (sheets, rods, wire, die forging products or pipes) have high strength, heat resistance and electrical conductivity.

The time fracture strength of the alloy is more than 300 MPa, its electrical conductivity is more than 53% IACS, specific elongation is above 4% and 100 h 300° C. heating yield stress is above 260 MPa.

Said technical result is achieved in the first object of this invention as follows.

The aluminum base alloy contains copper, manganese, zirconium, silicon, iron and chromium in the following amounts, wt. %:

| | |
|---|---|
| Copper | 0.6-1.5 |
| Manganese | 1.2-1.8 |
| Zirconium | 0.2-0.6 |
| Silicon | 0.05-0.25 |
| Iron | 0.1-0.4 |
| Chromium | 0.01-0.3 |
| Aluminum | balance |

The alloy contains zirconium in its structure in the form of $Al_3Zr$ phase nanosized particles not greater than 20 nm in size, and manganese mainly forms secondary particles of the $Al_{20}Cu_2Mn_3$ phase not greater than 500 nm in size in a quantity of at least 2 vol. %.

Said technical result is achieved in the second object of this invention as follows.

The method of fabricating wrought semifinished products from said aluminum base alloy comprises producing an alloy and fabricating a cast piece by solidifying said alloy, these operations being carried out at a temperature that is at least 50° C. above the liquidus temperature.

The intermediate wrought semifinished product is obtained by deforming said cast piece at a temperature of within 350° C. in two stages with an intermediate 340-450° C. anneal.

Then the intermediate wrought semifinished product is annealed at 340-450° C., and wrought semifinished product is obtained by deforming the intermediate wrought semifinished product at room temperature.

Finally the wrought semifinished product is annealed at 300-400° C.

Often said cast piece is wrought at room temperature.

Wrought semifinished products can be in the form of rolled sheets, wire, extruded bars or die forging products.

The matrix of the aluminum base alloy provided herein contains fine phase particles (secondary aluminides of transition metals including Mn, Cr and Zr) and does not contain the $Al_2Cu$ phase. The fine particle distribution in the aluminum matrix is uniform, and the element concentrations in the aluminum solid solution including those of the fine particle forming elements (Mn, Cr and Zr) are at a minimum.

The claimed alloying additive concentrations in the alloys are justified below.

Manganese and copper in the amounts claimed herein are required to form $Al_{20}Cu_2Mn_3$ phase fine particles in a quantity of at least 2 vol. % and max, 500 nm in size. At lower concentrations the quantity of said particles will be insufficient for achieving the required strength and heat resistance, while at higher concentrations the electrical conductivity and forming operation manufacturability will be impaired. If the size of the $Al_{20}Cu_2Mn_3$ phase fine particles is greater than 500 nm, the high temperature strength of the alloy will be dramatically impaired.

Zirconium in the amount claimed herein is required to form $Al_3(Zr)$ phase nanoparticles ($L1_2$ crystal lattice) with an average size of not greater than 20 nm. At lower concentrations the quantity of said particles will be insufficient for achieving the required strength and heat resistance, while at higher concentrations there is a risk of forming primary crystals ($D0_{23}$ crystal lattice) which have a negative effect on the mechanical properties and manufacturability of the alloy.

Chromium in the amount claimed herein can substitute manganese in the $Al_{20}Cu_2Mn_3$ phase or form fine particles of another phase (e.g. $Al_7Cr$) which also have a positive effect on heat resistance. Furthermore, chromium addition decelerates the decomposition of the aluminum solid solution during the fabrication of the intermediate wrought semifinished product by deforming the cast piece at up to 350° C.

Iron and silicon in the amounts claimed herein are required to form eutectic particles (e.g. the $Al_{15}(Fe,Mn)_3Si_2$ phase) which favor more uniform microdeformation during the forming operation. The presence of these elements has a positive effect on the formation of the final structure e.g. on the uniform distribution of $Al_{20}Cu_2Mn_3$ phase fine particles or $Al_3Zr$ phase nanoparticles.

The claimed process parameters for the fabrication of wrought semifinished products from said alloy are justified below.

Lowering the melt temperature to below $T_L$+50° C. ($T_L$ is the liquidus temperature) can produce coarse primary crystals of the $Al_3Zr$ phase during solidification and reduce the zirconium concentration in the aluminum solid solution. This will result in a smaller quantity of nanosized particles in the final structure and reduce the strength of the alloy.

If the initial piece deforming temperature is higher than 350° C., the size of the secondary Zr containing particles may exceed 20 nm which will reduce the strength of the alloy.

If the annealing temperature of the wrought semifinished product intermediate is below 340° C., the alloy structure will not contain $Al_{20}Cu_2Mn_3$ phase fine particles in quantities required for achieving high strength.

If the annealing temperature of the wrought semifinished product intermediate is above 450° C., the size of the secondary Zr containing particles may exceed 20 nm, and the size of the secondary Cu and Mn containing particles, e.g. $Al_{20}Cu_2Mn_3$, may exceed 500 nm which will reduce the strength of the alloy.

If the annealing temperature of the wrought semifinished product is below 300° C., the specific elongation of the wrought semifinished product will be below 4%.

If the annealing temperature of the wrought semifinished product is above 400° C., the size of the secondary Zr containing particles may exceed 20 nm which will reduce the strength of the alloy.

The liquidus temperature ($T_L$) can be determined using experimental or theoretical methods providing for sufficient accuracy. For example, we can recommend using Thermo-Calc software (TTAL5 or higher database).

BRIEF DESCRIPTION OF THE DRAWINGS

The invention is illustrated by the drawing where.

Figure 1:
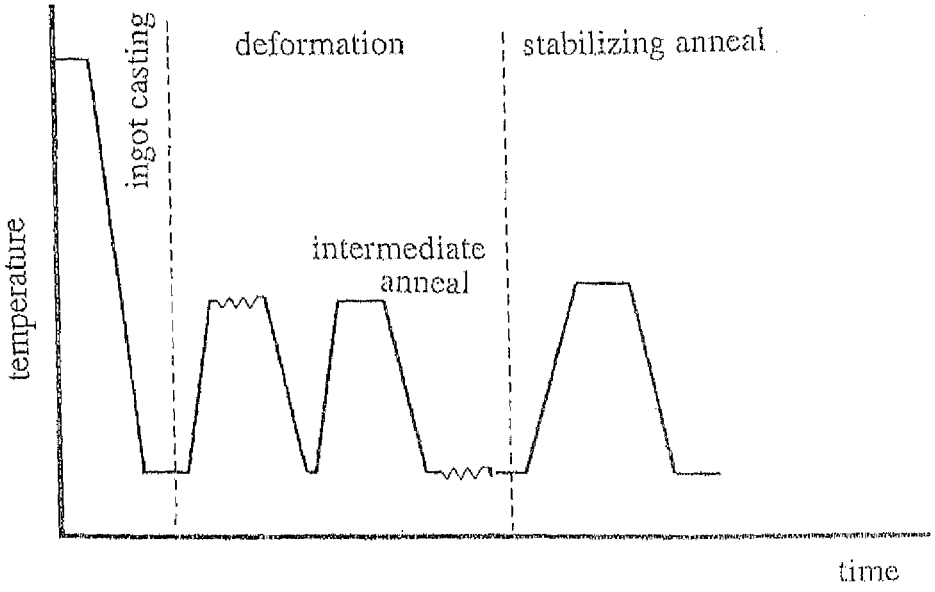
FIG. 1 shows process routes for the fabrication of wrought semifinished products from the alloy claimed herein and the AA2219 commercial alloy.
Figure 1:
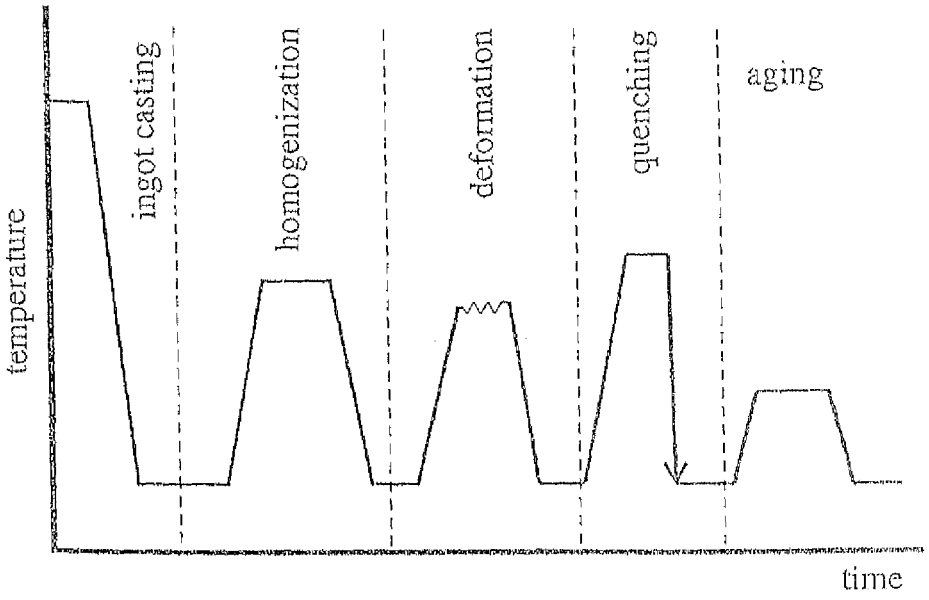

Comparison of the process routes shown in FIG. 1 demonstrates the significant reduction in process time (high manufacturability for forming operation without a homogenizing anneal and a shorter process of semifinished product fabrication), reduction of labor and power consumption for the fabrication of wrought semifinished products from the alloy claimed herein. The process does not require quenching equipment (quenching ovens or containers) and hence reduces the rate of quenching buckling defects in the wrought semifinished products. The good mechanical properties, high heat resistance and high thermal stability of the alloy broaden its applications including high temperature ones.

SPECIFIC EMBODIMENTS OF THE INVENTION

The alloy according to this invention can be obtained using commercial equipment for the production of wrought aluminum alloys. Alloys for the production of the material claimed herein were obtained in a resistance furnace from 99.99% aluminum, 99.9% copper and double alloys (Al—Mn, Al—Zr, Al—Fe, Al—Cr, Al—Si) in graphite fire clay crucibles. The composition of the alloy for the production of the material claimed herein was as compositions 2-4 in Table 1. Flat (15×60 mm section) and round (44 mm diam.) ingots were produced by casting into graphite and steel moulds respectively. The casting temperature was at least 50° C. above the liquidus temperature. The liquidus temperatures $T_L$ for each alloy were calculated using Thermo-Calc software (TTAL5 database).

The flat and cylindrical ingots were formed by flat rolling, die forging, extrusion and drawing on laboratory equipment, i.e. in a rolling mill, in a press, in an extruder, and in a drawing mill. The cast pieces were formed in two stages. First, intermediate wrought semifinished products were obtained by deforming the cast piece at a temperature of within 350° C. this operation was followed by an intermediate 340-450° C. anneal in a muffle electric furnace. The wrought semifinished products were obtained at room temperature. The final anneal of the wrought semifinished products was carried out at 300-400° C.

Figure 2:
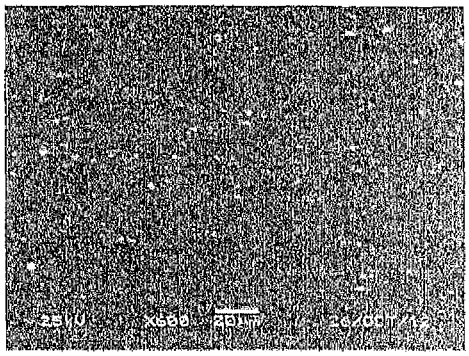
FIG. 2 shows typical microstructure of the wrought semifinished product (sheet) of Alloy No. 2 (Table 1) imaged by scanning electron microscopy that shows the aluminum solid solution with iron containing phase particles.
Figure 3:
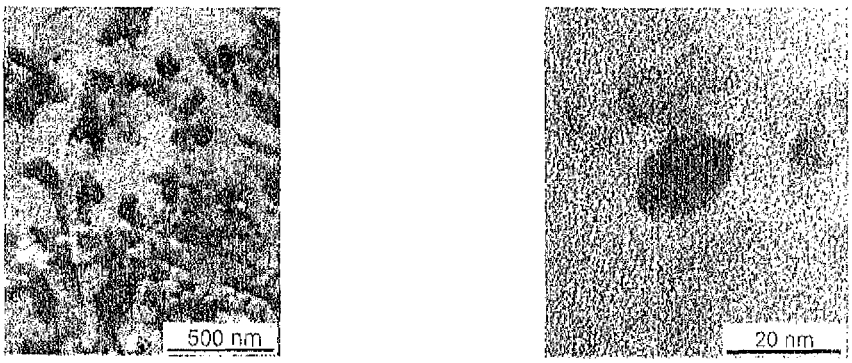
FIG. 3 shows typical microstructure of the wrought semifinished product (sheet) of Alloy No. 4 (Table 1) imaged by transmission electron microscopy that shows $Al_{20}Cu_2Mn_3$ phase fine particles in the aluminum solid solution and a fine particle of the $Al_3Zr$ in the aluminum solid solution.

The structure of the alloys was examined under a JSM-35 CF scanning electron microscope and a JEM 2000 EX transmission electron microscope. Typical microstructures are shown in FIGS. 2 and 3.

Tensile tests were carried out on a universal testing machine Zwick Z250 at a rate of 4 mm/min and a calculated length of 50 mm. The tested parameters were ultimate tensile strength (UTS), yield stress (YS) and specific elongation (El). The mechanical properties of the wrought semifinished products were also measured after the 100 h 300° C. anneal to determine both strength and heat resistance.

The electrical resistivity p of the wire and the sized flat specimens was measured using a $G^W$INSTEK GOM-2 digital programmable milliohm meter. Then the readings were recalculated to pure copper electrical conductivity (IACS).

Example 1

6 alloys were produced using the method claimed herein. The alloy compositions, liquidus temperatures and $Al_{20}Cu_2Mn_3$ phase fine particle volume contents at 300° C. are shown in Table 1. The mechanical properties and electrical conductivity of the cold rolled sheets were determined after a 100 h 300° C. anneal,

TABLE 1

Chemical Compositions and Liquidus Temperatures of the Test Alloys

| # | Concentrations, wt. % | | | | | | | |
|---|---|---|---|---|---|---|---|---|
| | Cu | Mn | Zr | Fe | Cr | Si | Al | $T_L$[2], ° C. |
| 1 | 0.5 | 0.5 | 0.1 | <0.01 | <0.01 | <0.01 | balance | 665 |
| 2 | 0.6 | 1.2 | 0.6 | 0.4 | 0.3 | 0.15 | balance | 830 |
| 3 | 1.5 | 1.5 | 0.36 | 0.25 | 0.01 | 0.05 | balance | 780 |
| 4 | 1.9 | 1.8 | 0.2 | 0.14 | 0.15 | 0.25 | balance | 741 |
| 5 | 2.5 | 2.5 | 0.8 | 0.5 | 0.5 | 0.3 | balance | 865 |
| 6[1] | 0.25 | 0.45 | 0.5 | <0.01 | <0.01 | 0.22 | balance | 811 |

[1]the alloy additionally contains 0.05% V);

[2]the calculated liquidus temperature (calculated using Calc software (TTAL5 database));

[3]the calculated $Al_{20}Cu_2Mn_3$ phase fine particle volume content at 300° C. (calculated using Calc software (TTAL5 database))

As can be seen from Table 1, the alloy provided herein (compositions 2-4) contains secondary $Al_{20}Cu_2Mn_3$ phase particles in a quantity of at least 2 vol. % and max. 500 nm in size. Alloys 1 and 6 contain secondary $Al_{20}Cu_2Mn_3$ phase particle in a quantity of less than 2 vol. %.

The tensile mechanical properties and electrical conductivity of the sheets obtained using said method after a 100 h 300° C. anneal are shown in Table 2.

As can be seen from Table 2, the as-annealed alloy provided herein (compositions 2-4) has the required strength, heat resistance and electrical conductivity due to the presence of $Al_3Zr$ phase fine particles of max. 20 nm in size and $Al_{20}Cu_2Mn_3$ phase fine particles of max. 500 nm in size. Alloy 1 has a lower strength, and Alloy 5 has a lower forming operation manufacturability and therefore cannot be used for the fabrication of high quality sheets. The as-annealed proto-type (Alloy 6) has insufficient strength and lower IACS.

TABLE 2

Tensile Mechanical Properties and Electrical Conductivity of 100 h 300° C. Annealed Sheets

| #* | UTS, MPa | YS, MPa | El, % | IACS, % |
|---|---|---|---|---|
| 1 | 240 | 180 | 9.1 | 55 |
| 2 | 320 | 280 | 5.1 | 54 |
| 3 | 330 | 290 | 4.5 | 54 |
| 4 | 340 | 320 | 4.1 | 53 |
| 5 | | Rolling Cracks | | |
| 6 | 285 | 230 | 7.8 | 41 |

*as in Table 1

Example 2

Wire and a extruded bar were produced from Alloy 3 (Table 1) using the method claimed herein. As can be seen from Tables 3 and 4, the alloy formed to wire and pressed semifinished product as-annealed at 300° C. for 100 h has the required strength and electrical conductivity. The size of the Zr containing phase ($Al_3Zr$) fine particles is about 10 nm, and that of the $Al_{20}Cu_2Mn_3$ phase fine particles is within 200 nm.

TABLE 3

Tensile Mechanical Properties and Electrical Conductivity of 100 h 300° C. Annealed Wire

| d, mm[1] | UTS, MPa | YS, MPa | El, % | IACS, % |
|---|---|---|---|---|
| 2 | 345 | 330 | 4.1 | 54 |
| 4 | 335 | 300 | 4.9 | 54 |

[1]wire diameter

TABLE 4

Tensile Mechanical Properties and Electrical Conductivity of 100 h 300° C. Annealed Extruded Bar

| d, mm[1] | UTS, MPa | YS, MPa | El, % | IACS, % |
|---|---|---|---|---|
| 10 | 355 | 335 | 5.2 | 54 |
| 16 | 340 | 330 | 5.8 | 54 |

[1]bar diameter

Example 3

Die forging discs were produced from Alloy 3 (Table 1) using the method claimed herein using three modes (Table 5):

a) intermediate wrought semifinished product by cast piece die forging at 450° C.;

b) intermediate wrought semifinished product by east piece die forging at 350° C.;

c) intermediate wrought semifinished product by cast piece die forging without heating (at room temperature).

Then the die forging products were annealed at 340-450° C. and die forged at room temperature. Finally they were annealed at 300° C. for 100 h.

TABLE 5

Tensile Mechanical Properties and Electrical Conductivity of 100 h 300° C. Annealed Die Punched Products

| $T_d$, ° C.[1] | UTS, MPa | YS, MPa | El, % | $Al_{20}Cu_2Mn_3$ phase fine particle size, nm |
|---|---|---|---|---|
| 450 | 260 | 225 | 8.2 | 650 |
| 350 | 320 | 275 | 5.0 | 250 |
| 25 | 330 | 290 | 4.1 | 150 |

[1]initial (maximum) deforming temperature

As can be seen from Table 5, the die punched products obtained from cast pieces at room temperature and at 350° C. have the required strength and electrical conductivity due to the size of the secondary Zr containing phase particles which is max. 20 nm and the size of the $Al_{20}Cu_2Mn_3$ phase fine particles which is within 500 nm. The die punched products obtained from cast pieces at 450° C. have a lower strength due to the large size of the secondary Zr containing phase particles which is above 50 nm.

Example 4

Ingots were obtained from Alloy 3 (Table 1) at different casting temperatures (950, 830 and 700° C.). Wrought semifinished products (sheets) were produced from the ingots as follows: the intermediate wrought semifinished product was produced by rolling the cast piece at within 350° C., followed by an intermediate anneal at 340-450° C., and then the wrought semifinished product was produced by rolling the intermediate wrought semifinished product at room temperature. Finally the wrought semifinished product was annealed at 300° C. for 100 h.

As can be seen from Table 6, reduction of the casting temperature to below the one claimed in this method reduces the strength of the alloy due to the presence of primary $Al_3Zr$ ($D0_{23}$) phase crystals 10-100 μm in size. Only at casting temperatures exceeding $T_L$+50° C. the alloy has the required strength and electrical conductivity, zirconium being present in the structure in the form of less than 20 nm sized $Al_3Zr$ ($L1_2$) phase particles.

TABLE 6

Tensile Mechanical Properties and Electrical Conductivity of 100 h 300° C. Annealed Sheets

| T, ° C.[1] | ΔT, ° C. | UTS, MPa | YS, MPa | El, % | IACS, % |
|---|---|---|---|---|---|
| 950 | 170 | 330 | 290 | 6.2 | 54 |
| 830 | 50 | 330 | 290 | 6.0 | 54 |
| 700 | −80 | 220 | 180 | 8.5 | 55 |

[1]casting temperature;

ΔT difference between the casting temperature and the liquidus temperature

Example 5

A cast piece was obtained from Alloy 3 (Table 1) using the method claimed herein. Following that the intermediate wrought semifinished product was produced by deforming the cast piece at within 350° C., the intermediate anneal of the alloy sheets (Table 1) at different temperatures (300, 340, 400, 450 and 550° C.), and then ready cold rolled sheets were produced and heat treated at 300° C. As can be seen from Table 7, only after a 340-450° C. intermediate anneal the alloy contains in its structure the $Al_{20}Cu_2Mn_3$ phase fine particles less than 500 nm in size and has the required strength and electrical conductivity. Reduction of the annealing temperature to below 340° C. results in a decrease in the electrical conductivity and hindered decomposition of the aluminum solid solution with the precipitation of the $Al_{20}Cu_2Mn_3$ phase fine particles (these particles were absent) during the preset time due to the low manganese diffusion rate in the aluminum solution. Increasing of the annealing temperature to above 450° C. reduces the strength of the alloy and increases the size of the $Al_{20}Cu_2Mn_3$ phase fine particles to above 500 nm and the size of the $Al_3Zr$ phase particles to above 100 nm.

TABLE 7

Tensile Mechanical Properties and Electrical Conductivity of Cold Rolled Sheets as a Function of Intermediate Annealing Temperature

| T, ° C.[1] | UTS, MPa | YS, MPa | El, % | IACS, % | $Al_3Zr$ phase particle size, nm | $Al_{20}Cu_2Mn_3$ phase particle size, nm |
|---|---|---|---|---|---|---|
| 300 | 270 | 250 | 6.0 | 34 | <10 | — |
| 340 | 320 | 280 | 5.1 | 53 | <20 | <150 |
| 400 | 335 | 290 | 4.8 | 53 | <20 | <200 |

TABLE 7-continued

Tensile Mechanical Properties and Electrical Conductivity of Cold Rolled Sheets as a Function of Intermediate Annealing Temperature

| T, ° C.[1] | UTS, MPa | YS, MPa | El, % | IACS, % | $Al_3Zr$ phase particle size, nm | $Al_{20}Cu_2Mn_3$ phase particle size, nm |
|---|---|---|---|---|---|---|
| 450 | 330 | 290 | 4.5 | 54 | <20 | <300 |
| 550 | 230 | 190 | 8.2 | 45 | >100 | >500 |

[1]maximum intermediate annealing temperature

Example 6

Wrought semifinished products were obtained using the method claimed herein in the form of sheets (1 mm thick) from the claimed alloy of composition 3 (Table 1). As can be seen from Table 8, only after a 300-400° C. anneal the alloy has the required mechanical properties, the alloy containing in its structure $Al_3Zr$ phase nanosized particles less than 20 nm in size, and manganese forming secondary $Al_{20}Cu_2Mn_3$ phase fine particles less than 500 nm in size.

Reduction of the annealing temperature to below 300° C. reduces specific elongation, and its increasing to above 400° C. reduces the strength due to the coarsening of the secondary $Al_3Zr$ phase particles to greater than 50 nm in size.

TABLE 8

Tensile Mechanical Properties and Electrical Conductivity of Cold Rolled Sheets as a Function of Final Annealing Temperature

| T, ° C.[1] | UTS, MPa | YS, MPa | El, % | $Al_3Zr$ phase particle size, nm |
|---|---|---|---|---|
| 200 | 335 | 300 | 2.9 | <20 |
| 300 | 330 | 290 | 4.0 | <20 |
| 350 | 320 | 275 | 4.2 | <20 |
| 400 | 300 | 265 | 6.1 | <20 |
| 500 | 240 | 200 | 8.5 | >50 |

[1]maximum final annealing temperature

What is claimed is a:

1. A method of fabricating a wrought semifinished product from an aluminum base alloy comprising the steps of:

producing a melt, comprising the following amounts, wt. %:

copper 0.6-1.5, manganese 1.2-1.8, zirconium 0.2-0.6, silicon 0.05-0.25, iron 0.1-0.4, chromium 0.01-0.3, aluminum balance, wherein the melt is formed at a temperature that is at least 50° C. above a liquidus temperature of the aluminum base alloy such that the zirconium is present in the form of $Al_3Zr$ phase particles sized less than 20 nm;

fabricating a cast piece by solidifying said alloy, obtaining an intermediate wrought semifinished product by deforming the cast piece at a temperature not to exceed 350° C. in two stages with an intermediate 340-450° C. anneal, annealing the intermediate wrought semifinished product at 340-450° C., wherein the range of 340-450° C. such that the aluminum base alloy comprises $Al_{20}Cu_2Mn_3$ particles that are sized less than 500 nm, obtaining the wrought semifinished product by the steps of:

deforming the intermediate wrought semifinished product at room temperature; and annealing the intermediate wrought semifinished product at 300-400° C. such that the zirconium containing particles of the aluminum base alloy are not sized greater than 20 nm and such that $Al_{20}Cu_2Mn_3$ particles that are sized less than 500 nm.

2. The method of claim 1 further comprising the step of deforming the cast piece at room temperature.

3. The method of claim 1 wherein the wrought semifinished product is produced in the form of a rolled sheet, a wire, an extruded bar, or a plurality of die forgings.

4. The method of claim 1 wherein the step of annealing the wrought semifinished product at 300-400° C. is performed for 100 hours at 300° C.

* * * * *